US010596835B2

(12) United States Patent
Veis

(10) Patent No.: US 10,596,835 B2
(45) Date of Patent: Mar. 24, 2020

(54) PRINT HEADS COMPRISING LIGHT EMITTING DIODES

(71) Applicant: HP SCITEX LTD., Netanya (IL)

(72) Inventor: Alex Veis, Netanya (IL)

(73) Assignee: HP SCITEX LTD., Netanya (IL)

( * ) Notice: Subject to any disclaimer, the term of this patent is extended or adjusted under 35 U.S.C. 154(b) by 0 days.

(21) Appl. No.: 16/142,282

(22) Filed: Sep. 26, 2018

(65) Prior Publication Data

US 2019/0176485 A1 Jun. 13, 2019

(30) Foreign Application Priority Data

Dec. 8, 2017 (EP) ..... 17206271

(51) Int. Cl.
*B41J 11/00* (2006.01)
*B41J 2/14* (2006.01)

(52) U.S. Cl.
CPC ..... *B41J 11/002* (2013.01); *B41J 2/14104* (2013.01)

(58) Field of Classification Search
CPC ..... B41J 2/05; B41J 2/14104; B41J 11/002
See application file for complete search history.

(56) References Cited

U.S. PATENT DOCUMENTS 4,532,530 A 7/1985 Hawkins
5,021,808 A * 6/1991 Kohyama ..... B41J 2/14104 346/46
5,219,785 A * 6/1993 Welch ..... H01S 5/20 148/DIG. 95
5,713,673 A * 2/1998 Nemoto ..... B41J 2/14104 400/120.02
6,474,783 B1 * 11/2002 Pilossof ..... B41J 2/14008 347/51
7,252,776 B2 8/2007 Chen et al.
7,332,127 B2 * 2/2008 Kim ..... B01L 3/0268 422/510
7,367,653 B2 5/2008 Yaron
8,100,510 B2 1/2012 Carlson et al.
9,573,368 B2 2/2017 North et al.
2005/0264600 A1 12/2005 Moffatt et al.
2007/0097180 A1 5/2007 Carlson et al.

FOREIGN PATENT DOCUMENTS

EP 0051468 5/1982
JP H0524197 2/1993

OTHER PUBLICATIONS

Hanson, Eric. "How an Ink Jet Printer Works", 2017, Retrieved from the Internet on Oct. 9, 2017: http://www.imaging.org/site/IST/Resources/Imaging_Tutorials/How an_Ink_Jet_Printer_Works/IST/Resources/Tutorials/Inkjet_Printer.aspx?hkey=5c0e9b54-b357-4dbb-b440-f07557f5163e.

* cited by examiner

*Primary Examiner* — Anh T Vo
(74) *Attorney, Agent, or Firm* — HP Inc. Patent Department

(57) ABSTRACT

In an example, a print head includes a nozzle, a fluid channel to provide printing fluid to the nozzle and a Light Emitting Diode (LED). The LED may emit light to heat printing fluid in the fluid channel causing localised vaporisation of the printing fluid and ejection of a fluid drop through the nozzle.

12 Claims, 3 Drawing Sheets

PRINT HEADS COMPRISING LIGHT EMITTING DIODES

BACKGROUND

In print operations, liquid printing agents such as inks, fixers, primers and coatings may be applied to a substrate. In some examples, liquid print agents are expelled from the nozzles of a print head in 'ink jet' print operations. In one such technology, so called 'bubble jet' printing, print agent in a fluid cell is locally heated to cause formation of a vapour bubble. The resulting increase in pressure within the cell causes the ejection of a print agent droplet from a nozzle in the fluid cell.

BRIEF DESCRIPTION OF DRAWINGS

Non-limiting examples will now be described, with reference to the accompanying drawings, in which.

DETAILED DESCRIPTION

Figure 1:
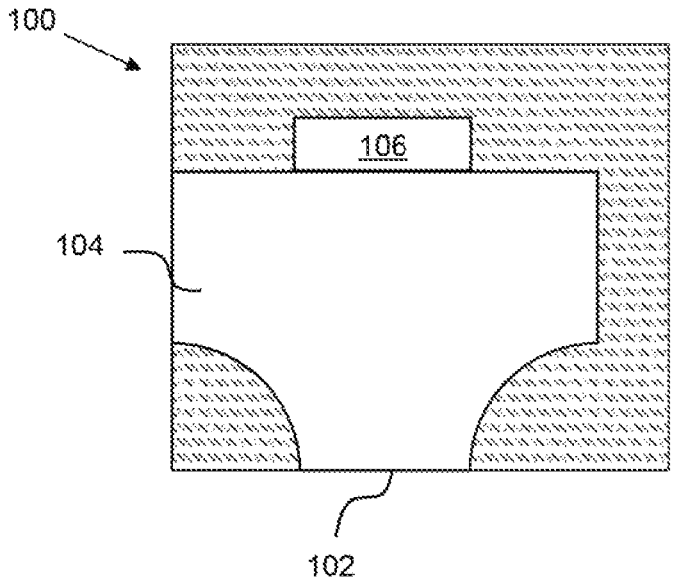
FIG. 1 is a simplified schematic of an example of a print head.

FIG. 1 shows an example of a print head 100 comprising a nozzle 102, a fluid channel 104 to provide printing fluid to the nozzle 102; and a Light Emitting Diode (LED) 106 which, in use of the print head 100, emits light to heat printing fluid in the fluid channel 104, for example in a selective manner, causing localised vaporisation of the printing fluid and ejection of a fluid drop through the nozzle. The LED may comprise an ultraviolet light emitting diode (uLED), for example a 300 nm LED, a 375 nm LED, a 395 nm LED or a 410 nm LED. A 395 nm LED is an example of a readily available LED. Another such example is a 410 nm LED.

In an example, the light emitted from the LED 106 is associated with a higher colorant absorption efficiency than solvent absorption efficiency. The print head 100 may cause local vaporisation of solvent fluid of a print agent such as printer ink comprising at least one colorant (for example, a pigment or dye), wherein the heating of the solvent fluid (for example, water) is substantially due to heat transfer from the colorant. In some examples, the LED 106 emits light in a relatively narrow band (for example, having a bandwidth of around 20-30 nm) in the UV range, for example having a central frequency between 200-400 nm.

While the nozzle 102 and the fluid channel 104 are illustrated to have particular shapes and relationships, in practice, these may vary considerably from those depicted.

In an example, a print apparatus may print with a predefined color set, which may be a yellow, magenta, cyan and black (CYMK) color set. In one example, the print agents may be aqueous (i.e. water based) inks. Vaporisation of the ink to create a 'bubble' in bubble jet printing heating means heating the solvent. In the example of aqueous print agents, this generally means providing heat energy, which is generally achieved by providing a thin film resistor within the print head which, when activated, heats the liquid in contact therewith via conduction and may also emit infrared radiation.

In practice, in addition to heating the print agent, a significant portion of the energy from such resistors is dissipated into the surrounding apparatus. In addition, heat leaves the system when heated ink is jetted from the print head. As the ink supply is replenished in the fluid channel 104, the fluid channel 104 is cooled. This can result in a temperature differential over different nozzles, dependent on their previous activation temperatures, how recently and often they have been activated, their location within the print head (for example, nozzles at an edge may be cooler than those at the centre of a print head). This can cause non-uniform jetting and image artefacts. Moreover, the power consumed is relatively high, and individual resistors can vary in terms of performance (both inherently, and over their life span) resulting in inconsistent jetting.

Finally, the materials which can be jetted using heated resistors is restricted. This is because print agents such as ink may contain solid materials like pigment and binders (which function to adhere the pigment to a printed substrate such as paper). At high temperatures, such solid materials may form deposits on the surface of the resistor. Other chemicals may react with a resistor surface and partially cover and/or etch it.

However, in this example, rather than providing a resistor heat source within the print head, the print head comprises an LED, which may emit light in the UV range. This utilises an alternative heating mechanism: while the print fluid solvent may not efficiently absorb ultraviolet radiation, the colorant particles, which may be suspended in the solution, do, and these then radiate heat. Since around 75% to 100% of emitted energy is absorbed by the print fluid, less energy will be needed, with less energy lost to the heating of the print head. Therefore, the working temperature in steady state operation may be generally lower than in resistive heating methods.

For the sake of comparison, an ink which absorbs 30% of the incident energy will use 2.5 times the energy as would produce the same evaporation for an ink with a 75% absorption efficiency, resulting in additional energy consumption and associated costs. LEDs are also efficient in terms of converting electrical energy to radiation, for example achieving efficiencies of up to around 90%. The process of energy transfer from electrical current in to heat is almost instant when using LEDs (for example, being measured in nanoseconds rather than microseconds, as is the case with thin film resistors). This can increase the droplet ejection frequency, potentially increasing print speeds, while also contributing to reducing energy consumption as energy need be delivered for a shorter period of time to cause a droplet to be ejected. Moreover, life spans of the apparatus may improve as generalized heating of the print head and surrounding apparatus is reduced, and the choice or print agent may be increased as the compatibility of print agents with a thin film resistor need not be considered. Finally, print quality may be improved due to a more consistent performance across an array of nozzles.

Thus while the hardware may be more complex (and at least at the time of writing, more expensive) than thin film resistor based print heads, increases in life span, and energy efficiency offset this.

Figure 2:
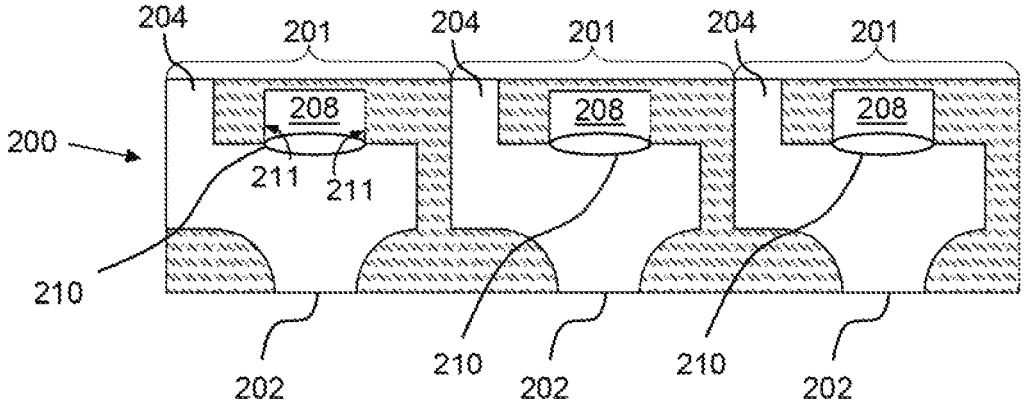
FIG. 2 is a simplified schematic of another example of a print head.

FIG. 2 is another example of a print head 200, in this example comprising a plurality of fluid ejection cells 201, each cell 201 comprising a nozzle 202, a fluid channel 204 and an LED 208. The LEDs 208, which in this example comprise 395 nm ultraviolet LEDs are formed integrally to the print head 200, and in this example are etched in a semiconductor material in a single process comprising the formation of the fluid channel. In this example, the LEDs have a wave band of less than 30 nm. While three cells 201 are shown, there may be more in other example print heads.

In other examples, the LEDs 208 may be formed in a first layer of semiconductor material and the fluid channel may be formed in a second layer of semiconductor material, and the two layers may be sandwiched together, for example with use of adhesive.

In this example, the print head 200 comprises optical beam shaper elements 210, in this example provided as lenses mounted in association with the LEDs 208.

Each beam shaper element 210 focuses the light away from the surface through which the LED 208 irradiates the fluid channel 204, which in turn means that the vapour bubble may also form away from the surface (for example, the surface may comprise a translucent window, encapsulation layer or the like of the LED, or indeed the beam shaper elements 210 itself, through which the LED irradiates the print agent). For example, the beam shaper elements 210 may be configured such that the bubble forms a few microns from the beam shaper elements 210. The energy may thereby be focussed to be away from at least one wall of the fluid channel. This may reduce deposits and/or heating of the print head itself, and thus may extend the nozzle life time.

While in this example, the beam shaper elements 210 are shown as lenses through which the LEDs 208 irradiate the channel, in other examples other optical components, such as reflectors 211 mounted on the side walls of the fluid channel 204 or elsewhere in the optical path way, may be used to concentrate the energy away from the surface through which the LED irradiates the fluid channel 204 (and in some examples, any other interior surface of the fluid channel).

The beam shaper elements 210 may comprise microlenses, reflectors or other optical components, which may be formed using etching or lithographic techniques, in some examples in the same process in which the LEDs 208 are formed, and may be integral thereto (for example, being formed in the material which encapsulates the LEDs 208, or which separates them from the printing fluid), or may be formed in a separate layer, or as discrete components which may be placed into an intended location.

Figure 3:
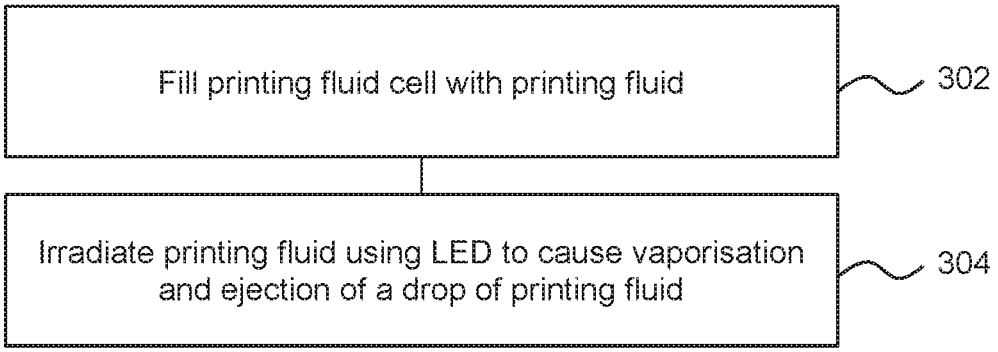
FIG. 3 is an example of a method of ejecting ink.

FIG. 3 is an example of a method of ejecting ink, for example onto a substrate. The method comprises, in block 302, filling a printing fluid cell comprising an ejection nozzle with a printing fluid. Block 304 comprises irradiating the printing fluid within the printing fluid cell using a Light Emitting Diode (LED) to cause localised vaporisation of the fluid and ejection of a drop of the printing fluid via the ejection nozzle.

Irradiating the printing fluid in block 304 may comprise irradiating the printing fluid using radiation in a bandwidth from within a range of 200 to 450 nm. The irradiation may comprise a pulse of light. As discussed above, in some examples, the radiation may be concentrated in a location within the printing fluid cell which is separated from the LED (and in some examples, from all side walls of the LED), for example by at least a few microns. For example, irradiating the printing fluid in block 304 may comprise irradiating the printing fluid via a lens, or the radiation may be directed towards a focus point or zone using reflectors or the like.

In one example, the power output by an LED in order to cause evaporation of the print agent/printing fluid so as to cause a bubble may be determined according to the following principles.

First, the volume of print agent to be evaporated may be evaluated. For example this may comprise around 0.1 or 0.2 picolitres of print agent, but may depend on the form of a print head and/or the size of a drop to be ejected. The energy to evaporate the liquid may also be evaluated (which may be the energy to boil the determined volume of water for aqueous print agent). To consider a particular example, the intended firing rate may be around 10 kHz (i.e. a firing rate of 10,000 drops per second) and assuming an LED area of around 50×50 μm for example and a power density of around 160 W/cm, and appropriate LED may emit around 1.6 $\mu W/\mu m^2$. For example if it is intended to evaporate 0.2 pl of printer fluid to produce a single droplet at a rate of 10 KhZ, then an LED may be controlled or selected to supply around 1 mW to 5 mW. The electrical power may be higher, for example up to around double this, due to inefficiencies within an LED. This energy may be supplied in a pulse around 1 to 50 μs (noting that, for shorter pulses, the power may increase). In case of shorter pulses, the dose of energy/total power per pulse may generally be the same or lower than for longer pulses (as there may be reduced thermal losses over the period of a shorter pulse).

In some examples, filling the fluid cell in block 302 comprises filling the fluid cell with a printing fluid of a predetermined colour and irradiating the printing fluid comprises irradiating the printing fluid using an LED which emits light in a portion of the electromagnetic spectrum which is absorbed by a colorant of the printing fluid with a radiation absorption efficiency of at least 50%, or in some examples, at least 70%.

Figure 4:
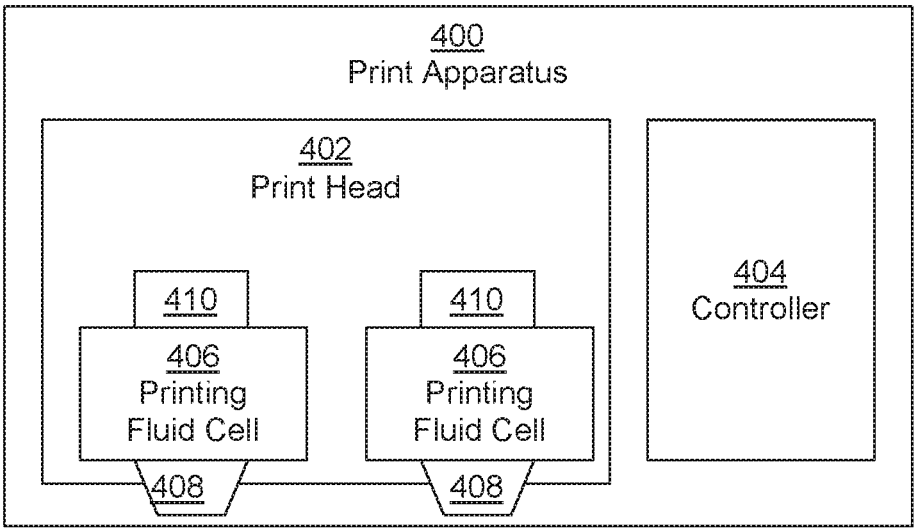
FIG. 4 shows a simplified schematic of an example of print apparatus.

FIG. 4 shows an example of a print apparatus 400 comprising a print head 402 and a controller 404. The print head 402 comprises a plurality of printing fluid cells 406, each printing fluid cell 406 comprising an ejection nozzle 408 and a Light Emitting Diode (LED) 410. The LED 410 emits light to heat printing fluid in the printing fluid cell 406 to cause localised vaporisation of the printing fluid and ejection of a fluid drop through the ejection nozzle 408. In use of the apparatus 400 the controller 404 selectively actuates the LEDs 410 of each printing fluid cell 406 in accordance with control data.

For example, the control data may specify when to eject a print drop as a substrate passes relative thereto. In some examples, the print head 402 may be mounted in a carriage, or otherwise mounted to as to move relative to an underlying substrate. In other examples, one or more print heads may provide a 'page wide array' of nozzles 408, and the substrate may be moved past the nozzle array.

As noted above, the print head 402 may comprise beam shaping elements 210 as described in relation to FIG. 2, to concentrate the light away from the LEDs 410 (for example, having a focus point or zone which is separated from a lens or encapsulate of an LED 410 by at least a few microns) and, in some examples, so as to be away from all side walls of a printing fluid cell 406.

While two printing fluid cells 406 are shown in FIG. 4, there may be more such cells 406 in other examples.

Figure 5:
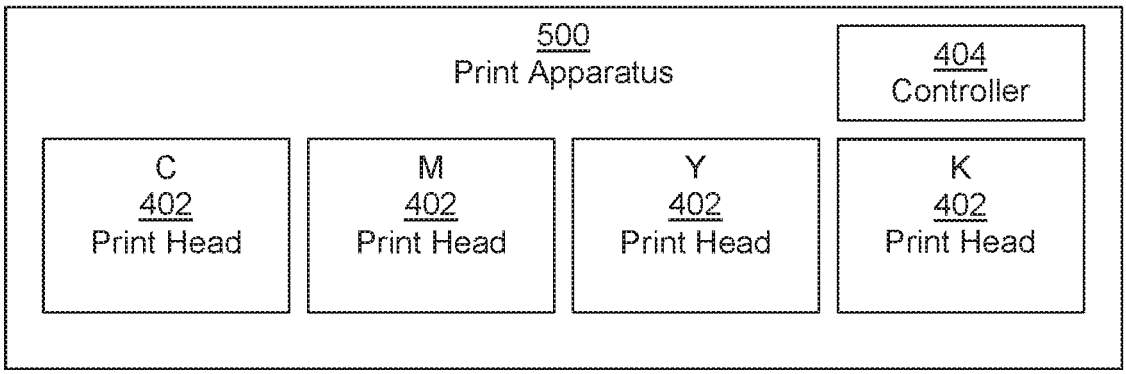
FIG. 5 is a simplified schematic of another example of print apparatus.

FIG. 5 shows another example of a print apparatus 500, which in this example comprises a plurality of print heads 402 (in this example, four), each being as described in relation to FIG. 4. In this example, each print head is associated with a particular colorant, and the LEDs 410 of each print head 402 emit light in a common waveband. In other words, all of the LEDS 410 in a particular print head 402 emit light in the same waveband, for example all comprising 395 nm LEDs, or all comprising 410 nm LEDs, or the like. In this example, the print heads 402 dispense cyan C, magenta M, yellow Y and black K colorants dissolved or suspended in water respectively.

In addition, in this example, the LEDs of print heads associated with different colourants emit light in a common waveband. In other words, all of the LEDS 410 in the printer emit light in the same waveband, for example all comprising 395 nm LEDs, or all comprising 410 nm LEDs. Although in another example, the emission spectrum of the LEDs in one print head 402 may differ from those of another, for example being selected based on the colorant so as to increase absorption efficiency, the use of a particular LED, in particular if it is associated with a relatively high absorption across the range of colorants, may be used and this may simplify manufacture and repair of the print apparatus 500.

In some examples, the LEDs 410 may operate to emit different wavebands and/or the wavelength of light emitted by one or more LED 410 may be controllable. LEDs 410 may be selected or controlled according to a color, or combination of colors, to be printed.

Figure 6:
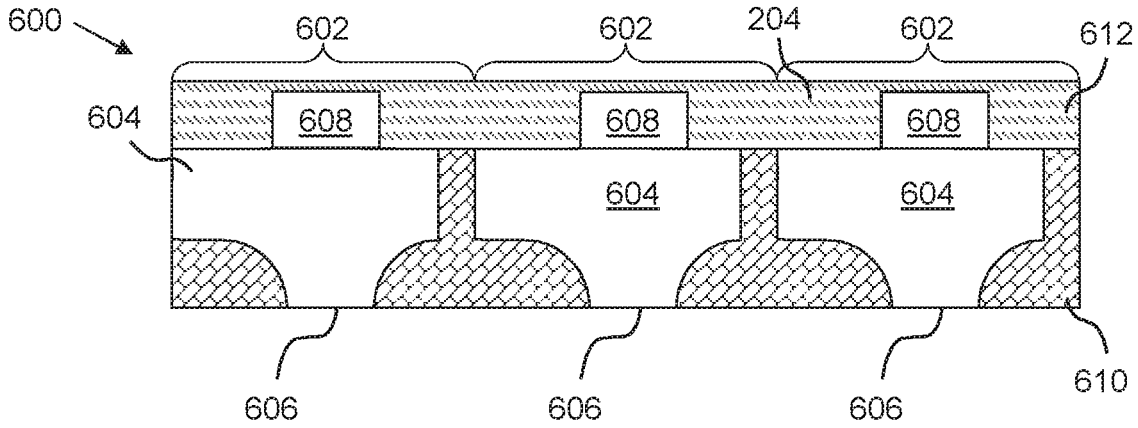
FIG. 6 is a simplified schematic of another example of a print head.

FIG. 6 is an example of a print head 600 comprising a plurality of printing fluid cells 602, each printing fluid cell 602 comprising a fluid channel 604 (which may have an inlet formed within the plane of the layer, which is therefore not visible in the figure), an ejection nozzle 606 and a Light Emitting Diode (LED) 608. The fluid channels 604 are etched in a first semiconductor wafer 610 and the LEDs are formed on a second semiconductor wafer 612, wherein the first and second semiconductor wafers 610, 612 are adhered to one another.

The LEDs 608 are selected or controlled to emit light in a portion of the electromagnetic spectrum absorbed by colorant(s) of printing agents such that vaporisation of water from the water-based printing substance is caused by heat transfer from the colorant(s). For example, the LEDs 608 may comprise diodes which emit radiation in a bandwidth selected from within the wavelength range 300-450 nm. The bandwidth may be around 20 nm-30 nm. As noted above, the print head may comprise beam shaping elements 210 as described in relation to FIG. 2, to concentrate the light away from the LEDs 608 and/or sidewalls.

In general, one or more LED may be selected or controlled to emit a waveband which is effective at heating the color or colors to be printed. For example, the most efficient waveband for heating color pigments such as Cyan, Yellow, Magenta, Green, Blue, Violet and so on, may be identified and used to control or instruct the choice of light source. In some examples, the waveband(s) of light emitted may be controlled or selected according to heating efficiency and/or providing a relatively balanced energy absorption efficiency for the inks applied or anticipated in a particular print operation.

The present disclosure is described with reference to flow charts and/or block diagrams of the method, devices and systems according to examples of the present disclosure. Although the flow diagram described above show a specific order of execution, the order of execution may differ from that which is depicted.

While the method, apparatus and related aspects have been described with reference to certain examples, various modifications, changes, omissions, and substitutions can be made without departing from the spirit of the present disclosure. It is intended, therefore, that the method, apparatus and related aspects be limited solely by the scope of the following claims and their equivalents. It should be noted that the above-mentioned examples illustrate rather than limit what is described herein, and that those skilled in the art will be able to design many alternative implementations without departing from the scope of the appended claims.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims. Features described in relation to one example may be combined with features of another example.

The invention claimed is:

1. A print head comprising:

a nozzle;

a fluid channel formed in a single semiconductor layer to provide printing fluid to the nozzle; and a Light Emitting Diode (LED) to emit light to heat a printing fluid in the fluid channel causing localized vaporization of the printing fluid and an ejection of a fluid drop through the nozzle;

wherein the LED is formed integrally in the single semiconductor layer with the fluid channel.

2. A print head according to claim 1, comprising a plurality of fluid ejection cells, each cell comprising a nozzle, a channel and an LED.

3. A print head according to claim 1 wherein the LED is to emit ultraviolet radiation.

4. A print head according to claim 3, wherein the print head comprises an optical beam shaping element to concentrate the light emitted at a location which is spaced from the LED.

5. A print head according to claim 1 in which the LED is to emit radiation with a bandwidth of less than 30 nm.

6. A method comprising:

filling a printing fluid cell comprising an ejection nozzle with a printing fluid; and irradiating the printing fluid within the printing fluid cell using a Light Emitting Diode (LED) to cause localized vaporization of the printing fluid and an ejection of a drop of the printing fluid via the ejection nozzle, wherein the irradiating includes causing light to be reflected from a reflector mounted on an interior surface of the fluid cell to concentrate the light away from the LED or the interior surface.

7. A method according to claim 6 in which irradiating the printing fluid comprises irradiating the printing fluid using radiation in a bandwidth from within a range of 200 to 450 nm.

8. A method according to claim 6 further comprising concentrating the emitted radiation in a location which is separated from the LED.

9. A print apparatus comprising:

a print head comprising a plurality of printing fluid cells, each printing fluid cell comprising an ejection nozzle and a Light Emitting Diode (LED) to emit light to heat a printing fluid in the printing fluid cell to cause localized vaporization of the printing fluid and an ejection of a fluid drop through the ejection nozzle, wherein the LED and printing fluid cell are formed integrally in a single semiconductor layer; and a controller to selectively actuate the LED of each printing fluid cell in accordance with control data.

10. The print apparatus of claim 9 comprising a plurality of print heads, each print head being associated with a particular colorant, wherein the LED of each printhead emits light in a common waveband.

11. The print apparatus of claim 10 in which the LED of print heads associated with different colourants emit light in a common waveband.

12. The print apparatus of claim 9 in which at least one printing fluid cell comprises a beam shaping element.

* * * * *